US009615167B2

(12) United States Patent
Akino

(10) Patent No.: US 9,615,167 B2
(45) Date of Patent: Apr. 4, 2017

(54) VARIABLE DIRECTIVITY ELECTRET CONDENSER MICROPHONE

(71) Applicant: KABUSHIKI KAISHA AUDIO-TECHNICA, Machida-shi, Tokyo (JP)

(72) Inventor: Hiroshi Akino, Machida (JP)

(73) Assignee: KABUSHIKI KAISHA AUDIO-TECHNICA, Machida-Shi, Tokyo (JP)

( * ) Notice: Subject to any disclaimer, the term of this patent is extended or adjusted under 35 U.S.C. 154(b) by 0 days.

(21) Appl. No.: 14/718,632

(22) Filed: May 21, 2015

(65) Prior Publication Data

US 2015/0341721 A1 Nov. 26, 2015

(30) Foreign Application Priority Data

May 23, 2014 (JP) ..... 2014-106837

(51) Int. Cl.
*H04R 3/00* (2006.01)
*H04R 1/32* (2006.01)
(Continued)

(52) U.S. Cl.
CPC ..... *H04R 1/326* (2013.01); *H04R 1/406* (2013.01); *H04R 3/005* (2013.01); *H04R 19/016* (2013.01); *H04R 2430/20* (2013.01)

(58) Field of Classification Search
CPC ..... H04R 3/00; H04R 3/005; H04R 19/016; H04R 1/326; H04R 25/407; H04R 19/04;
(Continued)

(56) References Cited

U.S. PATENT DOCUMENTS

2012/0093340 A1* 4/2012 Shimura ..... H04R 3/00 381/92

FOREIGN PATENT DOCUMENTS

JP 2008-118260 A 5/2008
JP 2008118260 * 5/2008
(Continued)

OTHER PUBLICATIONS

Microphone Engineering Handbook; edited by Michael Gayford.

*Primary Examiner* — Paul S Kim
*Assistant Examiner* — Norman Yu
(74) *Attorney, Agent, or Firm* — Manabu Kanesaka

(57) ABSTRACT

Provided is a variable directivity electret condenser microphone that can simplify a circuit configuration, and outputs an audio signal in an unbalanced manner. Included are electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively, a first impedance converter having an input terminal connected to the first fixed electrode, a DC cut capacitor selectively connected between an output terminal of the first impedance converter and an input terminal of the second impedance converter, and a directivity variable switche that can alternatively select a mode from at least a first directivity mode to a third directivity mode.

5 Claims, 4 Drawing Sheets

(51) Int. Cl.
*H04R 19/01* (2006.01)
*H04R 1/40* (2006.01)
*H04R 29/00* (2006.01)

(58) Field of Classification Search
CPC ..... H04R 1/04; H04R 1/406; H04R 2430/21; H04R 29/004; H04S 2400/15
USPC ... 381/111, 74, 113, 92, 174, 122, 313, 355, 381/58, 123, 91
See application file for complete search history.

(56) References Cited

FOREIGN PATENT DOCUMENTS

| | | | |
|---|---|---|---|
| JP | 2012-065147 A | | 3/2012 |
| JP | 2012065147 | * | 3/2012 |

* cited by examiner

VARIABLE DIRECTIVITY ELECTRET CONDENSER MICROPHONE

RELATED APPLICATIONS

The present application is based on, and claims priority from, Japanese Application No. JP2014-106837 filed May 23, 2014, the disclosure of which is hereby incorporated by reference herein in its entirety.

BACKGROUND OF THE INVENTION

Field of the Invention

The present invention relates to a condenser microphone including a variable directivity function by including two microphone units back to back, and especially relates to a variable directivity electret condenser microphone that uses electrets for the condenser microphone units, and outputs an audio signal in an unbalanced manner.

Description of the Related Art

As a microphone that can vary directivity, one in which microphone units having a cardioid characteristic are arranged in front and back in a back to back manner has been proposed.

Typically, condenser microphones are suitable for collection of wideband sounds compared with dynamic microphones, and are superior in directional frequency response.

One that realizes the variable directivity by adding/subtracting a polarization voltage to be added to the respective condenser microphone units by taking advantage of characteristics of the condenser microphones is disclosed in "Condenser microphone with variable polar response", Microphone Engineering Handbook (p. 32, FIG. 1.18) written by Michael Gayford (Non-Patent Document 1).

Meanwhile, the applicant of the present application has an earlier filed patent application about a variable directivity condenser microphone that has overcome technical problems in the condenser microphone disclosed in Non-Patent Document 1, and this patent application is disclosed in JP 2012-65147 A.

According to the condenser microphone disclosed in JP 2012-65147 A, a decrease in output sensitivity and deterioration of S/N caused due to alternating current coupling of the front and back diaphragms like the condenser microphone disclosed in Non-Patent Document 1 can be prevented.

In the cases of using the two condenser microphone units that require the polarization voltage disclosed in Non-Patent Document 1 and JP 2012-65147 A, it is necessary to include a configuration that the polarization voltage of 60 V or more is obtained by a DC-DC converter or the like using a direct-current power source of about 5 to 20 V, which operates a circuit of an impedance converter or the like.

According to the above configuration, it is also necessary to include an auxiliary configuration of the above-described DC-DC converter and the like in the condenser microphone units, and thus it is inevitable to have an increase in the cost.

Therefore, the applicant of the present application also has a patent application about a variable directivity condenser microphone using an electret dielectric film in the two condenser microphone units, and this application is disclosed in JP 2008-118260 A. According to the variable directivity condenser microphone disclosed in JP 2008-118260 A, outputs of the two condenser microphone units are coupled with a variable-capacity capacitor (variable capacitor), whereby a microphone that can continuously change the directivity can be realized.

By the way, JP 2012-65147 A also discloses an example of a variable directivity condenser microphone using an electret condenser microphone unit that does not need the polarization voltage. According to an example using the electret condenser microphone unit disclosed in JP 2012-65147 A, phase adjustment means is employed, which includes a phase inverting amplifier in which a phase of input/output is inverted with a gain of "1", and selects outputs of the phase inverting amplifier and a non-inverting amplifier in which the phase of input/output is not inverted with the gain of "1". Therefore, employment of the phase adjustment means has a problem of complexity of a circuit configuration, and thus there is room for improvement.

Further, according to the variable directivity condenser microphone disclosed in JP 2008-118260 A, the configuration of coupling the outputs of the two electret condenser microphone units with the variable-capacity capacitor (variable capacitor) is employed. Therefore, an electrostatic capacity is changed when external vibration is added to the variable-capacity capacitor, and this becomes a cause of occurrence of noise.

Therefore, a measure against the external vibration that affects the variable-capacity capacitor is required, and there is room for improvement on this point.

Meanwhile, many of consumer microphones employ an unbalanced output system with a simple circuit configuration for audio signals, and consumer mixer circuits or microphone input terminals of amplifiers that receive the audio signals also employ an unbalanced input system, which can be put into practical use with low cost.

SUMMARY OF THE INVENTION

An objective of the present invention is to provide a variable directivity electret condenser microphone that overcomes the above-described problems of the electret condenser microphone that varies directivity by arranging two microphone units in front and back in a back to back state, and outputs an audio signal in an unbalanced manner.

A favorable embodiment (a first embodiment) of a variable directivity electret condenser microphone according to the present invention made to solve the above-described problems includes: electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively; a first impedance converter having an input terminal connected to the first fixed electrode; a second impedance converter; a DC cut capacitor selectively connected between an output terminal of the first impedance converter and an input terminal of the second impedance converter; and a directivity variable switch that is able to alternatively select a mode from at least a first directivity mode to a third directivity mode, wherein, when the directivity variable switch selects the first directivity mode, the DC cut capacitor is connected in series between the output terminal of the first impedance converter and the input terminal of the second impedance converter, when the directivity variable switch selects the second directivity mode, the second fixed electrode is connected to the output terminal of the first impedance converter, and the second diaphragm is connected to the input terminal of the second impedance converter, when the directivity variable switch selects the third directivity mode, the second diaphragm is connected to the output terminal of the first impedance converter, and the second fixed electrode is connected to the input terminal of the second impedance converter, and the first diaphragm is connected to a ground at all times, and an unbalanced output of an audio signal is derived from an output terminal of the second impedance converter.

Further, another favorable embodiment (a second embodiment) of a variable directivity electret condenser microphone according to the present invention made to solve the above-described problems includes: electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively; a first impedance converter having an input terminal connected to the first diaphragm; a second impedance converter; a DC cut capacitor selectively connected between an output terminal of the first impedance converter and an input terminal of the second impedance converter; and a directivity variable switch that is able to alternatively select a mode from at least a first directivity mode to a third directivity mode, wherein, when the directivity variable switch selects the first directivity mode, the DC cut capacitor is connected in series between the output terminal of the first impedance converter and the input terminal of the second impedance converter, when the directivity variable switch selects the second directivity mode, the second diaphragm is connected to the output terminal of the first impedance converter, and the second fixed electrode is connected to the input terminal of the second impedance converter, when the directivity variable switch selects the third directivity mode, the second fixed electrode is connected to the output terminal of the first impedance converter, and the second diaphragm is connected to the input terminal of the second impedance converter, and the first fixed electrode is connected to a ground at all times, and an unbalanced output of an audio signal is derived from an output terminal of the second impedance converter.

In either embodiment, it is desirable to set an electrostatic capacity of the DC cut capacitor equal to an electrostatic capacity between the second diaphragm and the second fixed electrode in the second electret condenser microphone unit.

Further, in a favorable embodiment, as the directivity variable switch, a two-interlocking type three-point selector switch can be favorably used.

Further, in the first embodiment of the variable directivity electret condenser microphone, the first electret condenser microphone unit is a front-side unit at a sound collection axis and the second electret condenser microphone unit is a back-side unit at the sound collection axis.

Still further, in the second embodiment of the variable directivity electret condenser microphone, the first electret condenser microphone unit is a back-side unit at the sound collection axis and the second electret condenser microphone unit is a front-side unit at the sound collection axis.

In either embodiment of the variable directivity electret condenser microphone, when the directivity variable switch selects the first directivity mode, the mode is set to unidirectivity, when the directivity variable switch selects the second directivity mode, the mode is set to bidirectivity, and when the directivity variable switch selects the third directivity mode, the mode is set to omnidirectivity.

The variable directivity electret condenser microphone according to the present invention includes the first and second impedance converters, the DC cut capacitor, and the selector switch as the directivity variable switch, in addition to the first and second electret condenser microphone units. Accordingly, the variable directivity electret condenser microphone that realizes an unbalanced output of an audio signal can be provided.

Therefore, the variable directivity electret condenser microphone according to the present invention does not need a special circuit configuration such as a phase inverting amplifier, and can simplify the circuit configuration, compared with the example disclosed in JP 2012-65147 A described above.

Further, the variable directivity electret condenser microphone according to the present invention can overcome the problem of occurrence of noise due to vibration caused by employment of a variable-capacity capacitor (variable capacitor), and can contribute to the simplification of the circuit configuration, compared with the example disclosed in JP 2008-118260 A described above.

DESCRIPTION OF THE PREFERRED EMBODIMENTS

Figure 1:
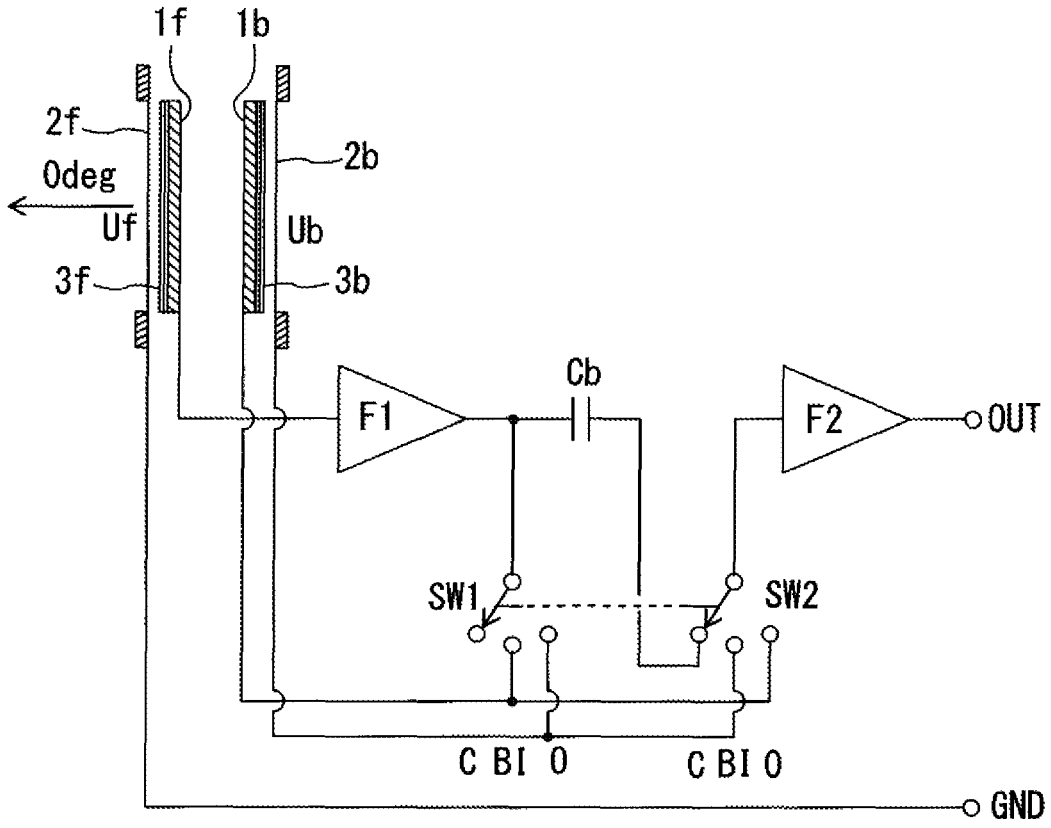
FIG. 1 is a block diagram illustrating a first embodiment of a variable directivity electret condenser microphone according to the present invention.

A variable directivity electret condenser microphone according to the present invention will be described based on embodiments illustrated in the drawings.

FIG. 1 illustrates a first embodiment, and the first embodiment is configured from two electrically independent electret condenser microphone units (first and second electret condenser microphone units) in front and back. Between these two electret condenser microphone units, one at a sound collection axis side illustrated by the arrow 0 deg is referred to as front-side unit Uf, and the other one at an opposite side is referred to as back-side unit Ub.

Then, first and second fixed electrodes 1*f* and 1*b* that configure the front-side unit Uf and the back-side unit Ub are arranged back to back in a mutually non-conductive state, and first and second diaphragms 2*f*, 2*b* are arranged facing each other with fixed intervals from the first and second fixed electrodes 1*f* and 1*b*, respectively.

In the present embodiment, electret dielectric films 3*f* and 3*b* are respectively provided on surfaces of the first and second fixed electrodes 1*f* and 1*b*, the surface facing the diaphragms 2*f* and 2*b*, and respectively configure back-electret condenser microphone units.

Figure 2:
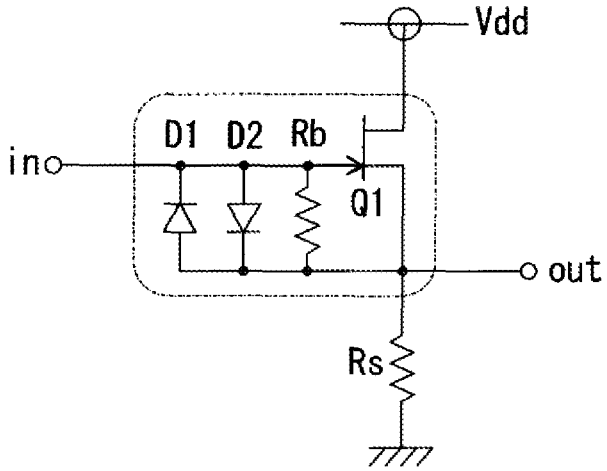
FIG. 2 is a connection diagram illustrating an example of an impedance converter used in the configuration illustrated in FIG. 1.

F1 and F2 illustrated in FIG. 1 are first and second impedance converters, and these first and second impedance converters are formed of the same circuit configuration as illustrated in FIG. 2 by a specific circuit configuration.

That is, as illustrated in FIG. 2, a bias circuit built-in type FET Q1 is included in the first and second impedance converters F1 and F2. Further, a direct-current operation power source Vdd is supplied to a drain of the FET Q1, and a source resistance Rs is connected to a source of the FET Q1, so that a source follower circuit is configured. A reference sign in illustrates an input terminal of the impedance converter, and a reference sign out illustrates an output terminal of the impedance converter.

Note that diodes D1 and D2, and a resistance Rb connected in reverse parallel are connected between the gate and the source of the FET Q1. These diodes D1 and D2, and the resistance Rb generate a gate bias of the FET Q1.

As illustrated in FIG. 1, a DC cut capacitor Cb is connected to the output terminal of the first impedance converter F1. The DC cut capacitor Cb serves as a DC cut function in a case where the other end portion of the DC cut capacitor Cb is connected to the input terminal of the second impedance converter F2 through a directivity variable switch described below.

Accordingly, the DC cut capacitor Cb servers as a function to prevent functional failure occurring due to difference between a direct-current level of the output terminal of the first impedance converter F1 and a direct-current level of the input terminal of the second impedance converter F2.

Further, reference signs SW1 and SW2 illustrated in FIG. 1 are two-interlocking type three-point selector switches, and the switches SW1 and SW2 function as directivity variable switches that alternatively select a mode from first to third directivity modes.

Then, when the switches SW1 and SW2 select the positions indicated by the reference signs C, the mode is set to unidirectivity (cardioid characteristics). When the switches SW1 and SW2 select the positions indicated by the reference signs BI, the mode is set to bidirectivity (bidirectional characteristics). Further, when the switches SW1 and SW2 select the positions indicated by the reference signs O, the mode is set to omnidirectivity (omnidirectional characteristics).

Directivity selecting functions based on these selections will be described below based on FIGS. 3 to 5.

As illustrated in FIG. 1, the first fixed electrode if that configures the front-side unit Uf is connected to the input terminal of the first impedance converter F1, and the output terminal of the first impedance converter F1 is connected to one end part of the DC cut capacitor Cb and is connected to a movable contact of the first switch SW1. Then, the other end part of the DC cut capacitor Cb is connected to a fixed contact C of the second switch SW2.

The second fixed electrode 1*b* that configures the back-side unit Ub is connected to a fixed contact BI of the first switch SW1 and is connected to a fixed contact O of the second switch SW2.

Further, the second diaphragm 2*b* that configures the back-side unit Ub is connected to a fixed contact O of the first switch SW1 and is connected to a fixed contact BI of the second switch SW2.

Further, a movable contact of the second switch SW2 is connected to the input terminal of the second impedance converter F2, and the output terminal of the second impedance converter F2 configures an output terminal OUT of an audio signal.

Meanwhile, the first diaphragm 2*f* that configures the front-side unit Uf is connected to a ground point GND. Therefore, in the present embodiment, the output terminal OUT of an audio signal of the variable directivity electret condenser microphone is configured to perform an unbalanced output between the microphone and the ground point GND.

Figure 3:
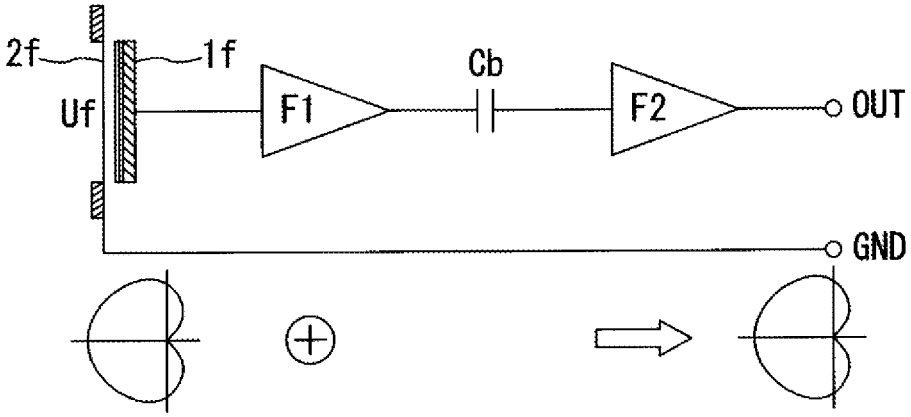
FIG. 3 is an equivalent circuit diagram of when a first directivity mode is selected in the configuration illustrated in FIG. 1.
Figure 4:
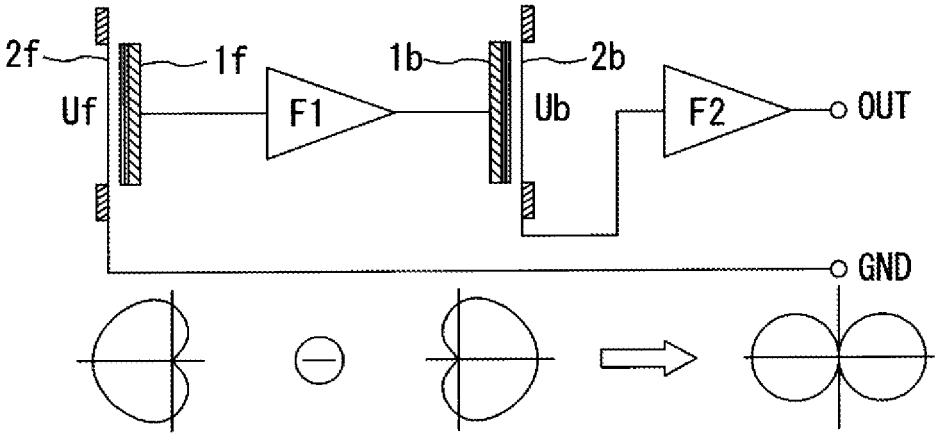
FIG. 4 is an equivalent circuit diagram of when a second directivity mode is similarly selected.
Figure 5:
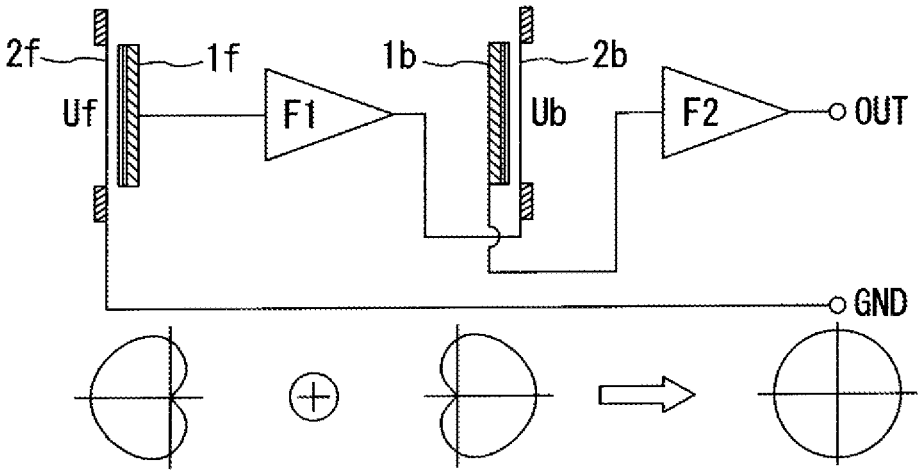
FIG. 5 is an equivalent circuit diagram of when a third directivity mode is similarly selected.

FIGS. 3 to 5 illustrate equivalent circuit diagrams of when the first and second switches SW1 and SW2 as directivity variable switches are respectively selected to the unidirectivity C, the bidirectivity BI, and the omnidirectivity O, in the above-described configuration illustrated in FIG. 1. Further, FIGS. 3 to 5 illustrate states of addition/subtraction calculation of polar patterns obtained by the front-side unit Uf and the back-side unit Ub, in addition to the equivalent circuit diagrams.

That is, when the directivity variable switches select the unidirectivity C that is a first directivity mode, the DC cut capacitor Cb is connected in series between the output terminal of the first impedance converter F1 and the input terminal of the second impedance converter F2, as illustrated in FIG. 3.

According to the connection configuration, an audio signal by the front-side unit Uf is output to the audio signal output terminal OUT through the first impedance converter F1, the DC cut capacitor Cb, and the second impedance converter F2.

Therefore, the polar pattern of the audio signal by the front-side unit Uf is output to the audio signal output terminal OUT, as it is, as illustrated in FIG. 3 by the polar pattern, and the characteristic of the unidirectivity can be obtained, accordingly.

Note that the DC cut capacitor Cb is desirably set nearly equal to an electrostatic capacity between the second diaphragm 2*b* and the second fixed electrode 1*b* that configure the back-side unit Ub.

That is, the electrostatic capacity between a diaphragm and a fixed electrode in this sort of condenser microphone is around several tens of pF, and an electrostatic capacity of around several tens of pF is similarly used for the DC cut capacitor Cb.

This is because, as illustrated in FIGS. 4 and 5 to be described next, a transmission system of an audio signal is set electrically equivalent to a configuration in which the electrostatic capacity by the back-side unit Ub between the second fixed electrode 1*b* and the second diaphragm 2*b* is inserted between the first impedance converter F1 and the second impedance converter F2.

Next, when the directivity variable switches select the bidirectivity BI that is a second directivity mode, the second fixed electrode 1*b* is connected to the output terminal of the first impedance converter F1, and the second diaphragm 2*b* is connected to the input terminal of the second impedance converter F2, as illustrated in FIG. 4.

According to the connection configuration, the signal by the front-side unit Uf from the first impedance converter F1 is added to the second fixed electrode 1*b*, and as a result, the signal by the back-side unit Ub is subtracted from the signal by the front-side unit Uf, and a signal after the subtraction is output to the audio signal output terminal OUT.

Therefore, as illustrated in FIG. 4 by the polar patterns, the polar pattern of the signal by the back-side unit Ub is subtracted from the polar pattern of the signal by the front-side unit Uf, and the bidirectivity can be obtained accordingly.

Further, when the directivity variable switches select the omnidirectivity O that is a third directivity mode, the second diaphragm 2*b* is connected to the output terminal of the first impedance converter F1, and the second fixed electrode 1*b* is connected to the input terminal of the second impedance converter F2, as illustrated in FIG. 5.

According to the connection configuration, the signal by the front-side unit Uf from the first impedance converter F1 is added to the second diaphragm 2*b*, and as a result, the signal by the back-side unit Ub is added to the signal by the front-side unit Uf, and a signal after the addition is output to the audio signal output terminal OUT.

Therefore, as illustrated in FIG. 5 by the polar patterns, the polar pattern of the signal by the back-side unit Ub is added to the polar pattern of the signal by the front-side unit Uf, and the omnidirectivity can be obtained, accordingly.

Figure 6:
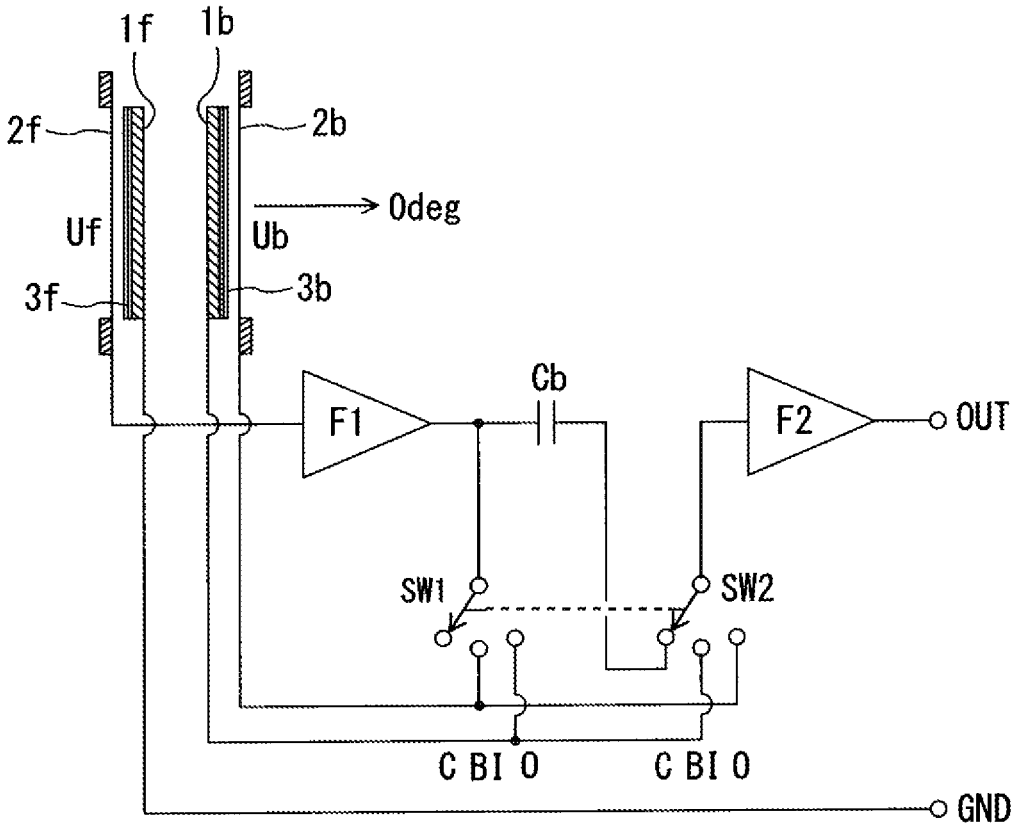
FIG. 6 is a block diagram illustrating a second embodiment of a variable directivity electret condenser microphone according to the present invention.

FIG. 6 illustrates a second embodiment of a variable directivity electret condenser microphone according to the present invention.

In the example illustrated in FIG. 6, a first fixed electrode 1*f* and a first diaphragm 2*f* in a front-side unit Uf are mutually switched and connected, and a second fixed electrode 1*b* and a second diaphragm 2*b* in a back-side unit Ub are also mutually switched and connected, with respect to the example illustrated in FIG. 1.

That is, the first diaphragm 2*f* that configures the front-side unit Uf is connected to an input terminal of a first impedance converter F1, and the first fixed electrode 1*f* is connected to a ground point GND.

Further, the second diaphragm 2*b* that configures the back-side unit Ub is connected to a fixed contact BI of a first switch SW1, and is connected to a fixed contact O of a second switch SW2.

Further, the second fixed electrode 1*b* that configures the back-side unit Ub is connected to a fixed contact O of the first switch SW1, and is connected to a fixed contact BI of the second switch SW2.

Other configurations are the same as the configurations illustrated in FIG. 1.

According to the configuration illustrated in FIG. 6, although the configuration is different from the variable directivity electret condenser microphone illustrated in FIG. 1 in that a sound collection axis illustrate by the arrow 0 deg comes to a front surface side of the back-side unit Ub, selecting operations of the respective directivities are similar to the equivalent circuit diagrams illustrated in FIGS. 3 to 5. Further, according to the configuration illustrated in FIG. 6, the sound collection axis of polar patterns is horizontally inverted with respect to the examples illustrated in FIGS. 3 to 5. However, a state of addition/subtraction calculation is similar to the examples illustrated in FIGS. 3 to 5.

What is claimed is:

1. A variable directivity electret condenser microphone comprising:

electrically independent first and second electret condenser microphone units in which first and second fixed electrodes are arranged back to back and facing each other in a mutually non-conductive state, and first and second diaphragms are arranged facing the first and second fixed electrodes with fixed intervals from the first and second fixed electrodes, respectively;

a first impedance converter having an input terminal connected to the first fixed electrode;

a second impedance converter;

a DC cut capacitor selectively connected between an output terminal of the first impedance converter and an input terminal of the second impedance converter; and a directivity variable switch that is able to alternatively select a mode from at least a first directivity mode to a third directivity mode, wherein, when the directivity variable switch selects the first directivity mode, the DC cut capacitor is connected in series between the output terminal of the first impedance converter and the input terminal of the second impedance converter, when the directivity variable switch selects the second directivity mode, the second fixed electrode is connected to the output terminal of the first impedance converter, and the second diaphragm is connected to the input terminal of the second impedance converter, when the directivity variable switch selects the third directivity mode, the second diaphragm is connected to the output terminal of the first impedance converter, and the second fixed electrode is connected to the input terminal of the second impedance converter, and the first diaphragm is connected to a ground at all times, and an unbalanced output of an audio signal is derived from an output terminal of the second impedance converter.

2. The variable directivity electret condenser microphone according to claim 1, wherein an electrostatic capacity of the DC cut capacitor is set equal to an electrostatic capacity between the second diaphragm and the second fixed electrode in the second electret condenser microphone unit.

3. The variable directivity electret condenser microphone according to claim 1, wherein the directivity variable switch is configured from a two-interlocking type three-point selector switch.

4. The variable directivity electret condenser microphone according to claim 1, wherein the first electret condenser microphone unit is a front-side unit at a sound collection axis and the second electret condenser microphone unit is a back-side unit at the sound collection axis.

5. The variable directivity electret condenser microphone according to claim 1, wherein, when the directivity variable switch selects the first directivity mode, the mode is set to unidirectivity, when the directivity variable switch selects the second directivity mode, the mode is set to bidirectivity, and when the directivity variable switch selects the third directivity mode, the mode is set to omnidirectivity.

* * * * *